United States Patent [19]

Roller et al.

[11] 4,437,145

[45] Mar. 13, 1984

[54] SHOCK ABSORBING LAMP ASSEMBLY FOR BASELESS CARTRIDGE BULBS AND THE LIKE

[75] Inventors: Philip C. Roller, Ashville; Chris A. Suckow, Frewsburg, both of N.Y.

[73] Assignee: Truck-Lite Company, Inc., Falconer, N.Y.

[21] Appl. No.: 410,957

[22] Filed: Aug. 24, 1982

[51] Int. Cl.[3] ..... F21V 7/00

[52] U.S. Cl. ..... 362/306; 362/61; 362/80; 362/307; 362/308; 362/310; 362/375; 362/376; 362/390

[58] Field of Search ..... 362/390, 369, 61, 80, 362/307, 308, 310, 375, 376

[56] References Cited

U.S. PATENT DOCUMENTS

| | | | |
|---|---|---|---|
| 3,327,110 | 6/1967 | Baldwin | 362/390 |
| 3,666,940 | 5/1972 | Magi | 313/50 |
| 4,070,567 | 1/1978 | Crompton | 313/50 |
| 4,176,391 | 11/1979 | Kulik et al. | 362/390 |
| 4,213,170 | 7/1980 | Kimball | 362/306 |
| 4,282,566 | 8/1981 | Newman | 362/390 |
| 4,360,861 | 11/1982 | Fitzgerald | 362/390 |

*Primary Examiner*—Stephen J. Lechert, Jr.
*Assistant Examiner*—Howard J. Locker
*Attorney, Agent, or Firm*—Mason, Fenwick & Lawrence

[57] ABSTRACT

A shock absorbing lamp assembly for baseless cartridge bulbs for on and off the road motor vehicles, including a rear backing lamp housing member serving as a reflector and lamp housing, a lens cover joined about its perimeter to the housing member to cover said cavity, an elongated baseless cartridge lamp bulb in the cavity having a larger central bulb portion housing filament wire and opposite generally flattened bulb end portions hermetically sealing about filament support pins to support the internal and external portions of the filament support pins, bulb mount assembly comprising a semicircular U-shaped mounting plate carried on swaged anchor formations of the housing member and a pair of forwardly projecting vertically and laterally flexible shock absorbing arms extending parallel to each other generally perpendicular to the axis of the bulb from the mounting plate formed of rubber-like material of about 60 durometer hardness and having terminal receiving apertures for receiving the flattened bulb end portions.

19 Claims, 7 Drawing Figures

Fig-1
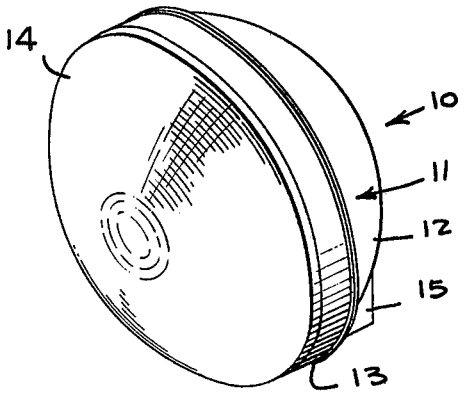
Fig-2
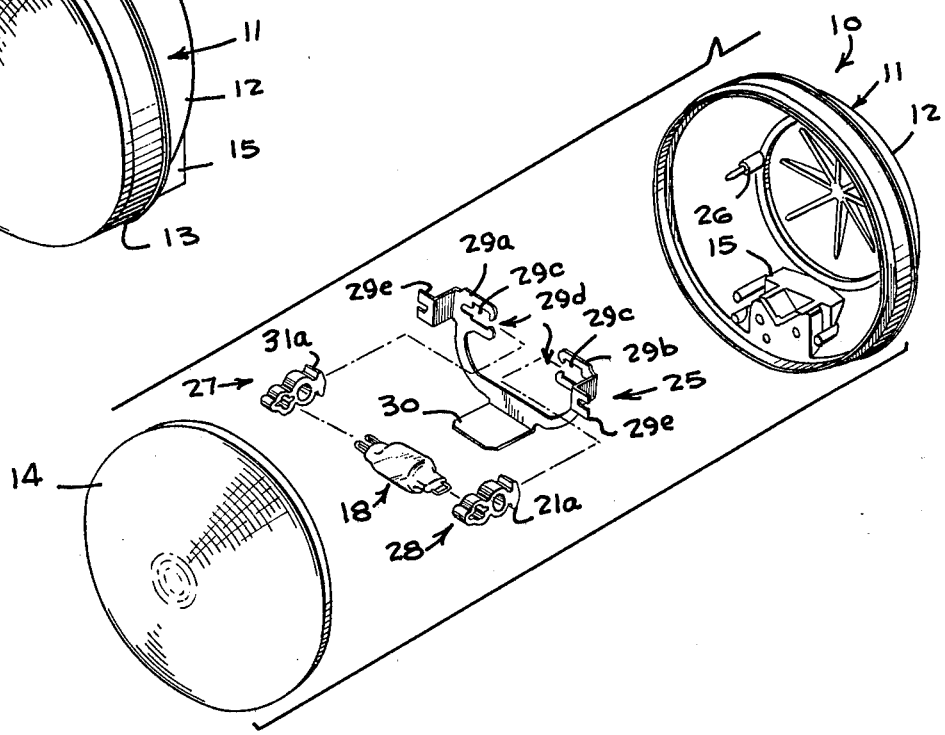
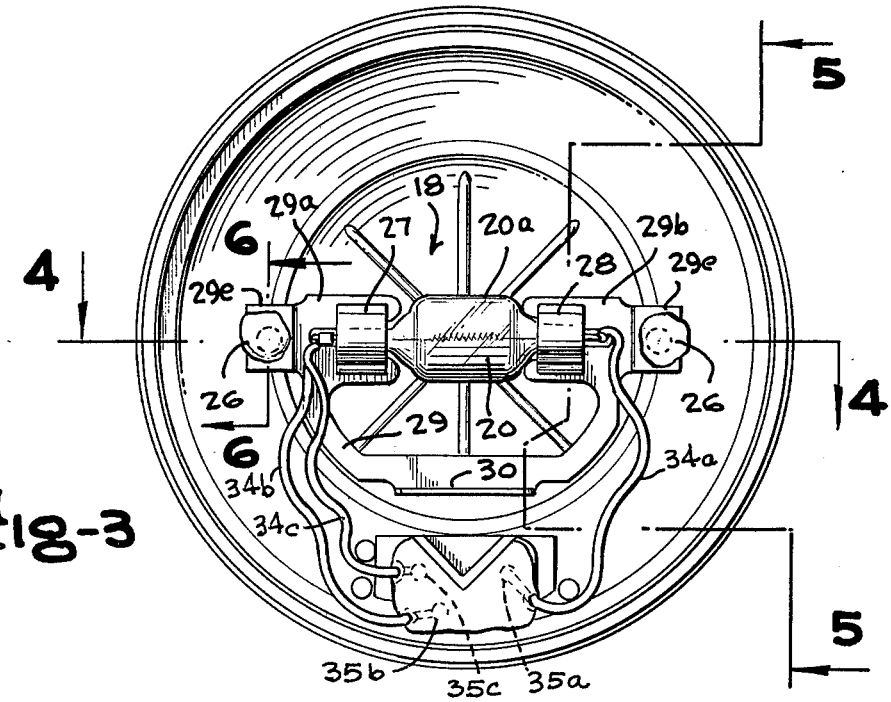
Fig-3

SHOCK ABSORBING LAMP ASSEMBLY FOR BASELESS CARTRIDGE BULBS AND THE LIKE

BACKGROUND AND OBJECTS OF THE INVENTION

The present invention relates in general to shock isolating lamp assemblies for automotive vehicles, particularly commercial vehicles such as trucks and the like, providing improved shock isolating and heat resistance properties, and more particularly to an improved shock isolating lamp assembly having a baseless cartridge bulb therein, for use particularly as safety lamps for on and off road motor vehicles, trailers, and the like, having improved shock and vibration dampening and heat resistance characteristics to allow longer life of the lamp assembly.

In the past, a number of arrangements have been proposed for shock mounting an incandescent lamp bulb within a lamp housing to be employed on motor vehicles, to reduce road shock and vibration effects on the filaments of the bulbs. As will be recognized by persons familiar with the art, automotive vehicles, and particularly trucks and similar commercial vehicles and trailers, are subject to recurrent road shocks in traveling over the highway and off road paths. These road shocks, transmitted through the frame of the vehicle, effect the relatively fragile filaments of the lamp bulbs in the marker, signaling and driving lamps of the vehicle, so that frequent breakage or disabling of such bulbs occurs due to the road shocks.

For many years, the electric light bulbs used in such signal, marker and driving lamps, were of the traditional construction wherein base portions, such as screw or bayonette bases, were provided forming the support base for the filament wires and supports therefor. Various shock mount arrangements have been proposed for such vehicle lamps involving the traditional base-type bulb, such as Dixon Pat. Nos. 3,059,104, 3,208,031, 3,222,512 and 3,115,307, showing use of a soft rubber receptacle or member to receive and support the base portion of the bulb for shock isolation purposes.

Other proposals have included resilient potting of an unbased lamp bulb within a receptacle portion of a lamp assembly suspended by flexible torque arms, proposed for example in U.S. Pat. No. 3,089,951, and use of a suspension structure including a pair of flexible arms extending laterally from opposite sides of a receptacle formation along serpentine paths curving about vertical axes and pivoted at their outer ends to the lamp housing have been proposed in U.S. Pat. No. 3,327,110, now U.S. Pat. No. Re. 30,498, assigned to the assignee of the present application, and similar U.S. Pat. Nos. 3,666,940, 4,241,371 and 4,282,566.

More recently, baseless cartridge lamps have been developed because of the great expense in manufacture of the base portions of the more traditional types of lamp bulbs, such as the screw or bayonette bases, relative to the remainder of the bulbs, and because the number of advantages arise from such a baseless cartridge lamp construction. In addition to the savings in mass producing such items, such as the assembly of such baseless-type cartridge bulbs with connectors for reliable and convenient mounting of the bulbs, the nature of the baseless cartridge bulb construction offers increased resistance to severe vibration and heavy shock loads, and permits use of reduced voltage levels needed to supply the bulb filament, which results in increasing filament life. While such baseless cartridge lamps, employed either as safety lamps or with dual filament construction permitting automotive tail and stop lamp illumination levels, have been previously used as automotive lamps, such baseless cartridge bulbs, to applicants' knowledge, have not been previously proposed for use in marker lamp, signaling lamp and driving lamp applications for trucks and similar vehicles subject to severe vibration, shock and heat problems.

An object of the present invention, therefore, is the provision of a novel shock absorbing bulb mount and lamp assembly for baseless cartridge lamps for use as marker, signaling and driving lamps of on and off road motor vehicles, trailers and the like, having novel bulb supporting arms of silicone rubber configurated and constructed to provide superior shock and vibration dampening characteristics allowing longer life due to increased resistance to vibration, shock and heat.

Another object of the present invention is the provision of a novel lamp assembly as described in the immediately preceding paragraph, wherein the mounting arms of silicone rubber for the baseless cartridge bulb connector/support ends, due to the unique shape and the flexibility of the silicone rubber under operating loads and conditions, achieves dampening of excessive shock impulses to the bulb filament.

Another object of the present invention is the provision of a shock mounted lamp assembly as described in either of the two preceding paragraphs, wherein a heat sink is incorporated in the form of a heat shield which serves to protect the silicone rubber shock mount arms from degradation and protects the plastic reflector portions of the housing structure from melting.

Another object of the present invention is the provision of a novel shock absorbing bulb mount and lamp assembly for baseless cartridge bulbs and the like as described in the immediately preceding paragraphs, which provide greater ease and economy of construction, increase bulb life by reducing the voltage applied to the filament through use of resistance wire, which can be radially mounted in any position in the normal vertical attitude, and which may be mounted in existing conventional mounting facilities of commercial vehicles and trailers without modification.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a perspective view of a shock absorbing vehicle lamp assembly for a baseless cartridge bulb, embodying the present invention;

FIG. 2 is an exploded perspective view of the lamp assembly;

FIG. 3 is a front elevation view of the lamp assembly, with the lens cover removed;

DETAILED DESCRIPTION OF A PREFERRED EMBODIMENT

Figure 4:
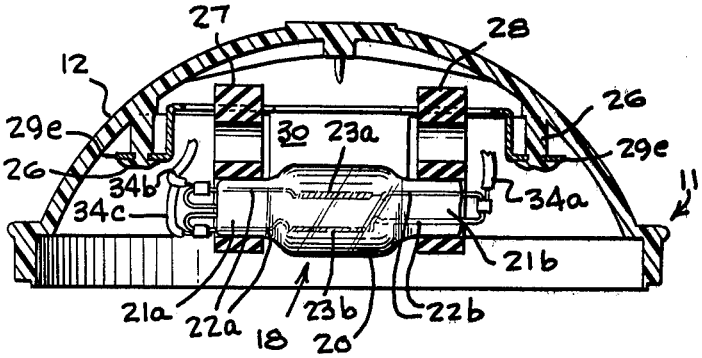
FIG. 4 is a horizontal section view, taken along the line 4—4 of FIG. 3.

Referring to the drawings, wherein like reference characters designate corresponding parts throughout the several figures, there is illustrated a vehicle lamp assembly constructed in accordance with the present invention, indicated generally by the reference character 10, formed of a lamp housing member 11, for example of molded plastic, shaped to form the concave reflector portion 12 of the lamp assembly, and having an annular, generally cylindrical rim portion 13 at the front or forward portion of the lamp housing member 11. The forwardly concavely-curved lamp housing member 11 is adapted to be securely mounted in any suitable fashion on a vehicle, where in many cases, it may be subjected to severe impulse forces. A lens cover member 14, also of molded plastic in the preferred embodiment, is sealed to the front or open end of the reflector forming lamp housing assembly 11. As will be apparent from FIGS. 1 and 2, the reflector forming housing member portion 11 is formed with an enlargement or extension formation 15 projecting rearwardly from the rim portion 13 and the adjacent portions of the reflector formation 12 within which a number of electrical connector elements, hereinafter referred to, are incorporated. This adapts the reflector portion 12 to receive an electrical connecting plug (not shown) through which electrical connections are established with filaments enclosed within the baseless cartridge incandescent bulb 18.

To secure the advantages of the improved vibration resistance of the filament and increased design life and reliability of baseless cartridge-type bulbs, a baseless cartridge-type bulb 18 of the type manufactured by Wagner Electric Corporation as the Wagner No. 571 cartridge bulb is employed, having the construction disclosed, for example, by U.S. Pat. No. 4,061,940 granted Dec. 6, 1977 to that company. As illustrated and disclosed in that patent, the baseless cartridge bulb primarily comprises a glass envelope 20 having a center portion 20*a* of substantially cylindrical configuration and two opposite, reduced diameter unbased ends 21*a*,21*b* treated to hermetically seal about filament support pins generally indicated at 22*a*,22*b* so that the glass rigidly supports the internal and external portions of the filament support pins in fixed spatial relationship to each other without need for continued external support. The filament support pins are electrically connected to and support one or two filaments, for example a major filament 23*a* and minor filament 23*b*, so as to provide dual filament functions of high intensity illumination and low intensity or dim signaling functions. Alternatively, the bulb may be of the type having a single filament wire providing a single level of illumination for certain well-known functions.

The baseless cartridge-type bulb 18 is supported within the housing member 11 by a support assembly primarily formed of a generally U-shaped combination mounting plate and heat shield, hereinafter usually referred to as the mounting plate or mounting platform, indicated generally by the reference character 25 rigidly supported by mounting post formations 26 molded in the concave reflector portion 12 of the housing member 11, and a pair of forwardly extending shock mount arms 27,28 of a distorted FIG. 8 configuration in side elevation formed of silicone rubber and dimensioned to be long enough and of appropriate flexibility to prevent bulb contact with the surfaces of the concave reflector portion 12 of the housing member and effect good shock isolation of the bulb 18. In the illustrated embodiment, the combination mounting plate and heat shield 25 may be formed of an electrically insulating plastic moldable material, but in the illustrated embodiment is hot dipped galvanized steel having a generally semi-circular U-shaped flat main body portion 29 having its perimeter extending in a circular path over most of its circumferential extent, with a forwardly extending flat, thin rectangular flange excursion 30 extending from the lowermost midregion of the body portion 29, in the orientation illustrated. A pair of enlarged, horizontally aligned mounting formations 29*a*,29*b* extend inwardly toward the center axis of the lamp substantially at the horizontal axis or plane passing through said center axis, having a pair of mounting-arm-receiving diametrically opposite slots 29*c* opening inwardly toward said center axis at approximately the 3 o'clock and 9 o'clock positions.

These mounting-arm-receiving slots 29*c* include a convergent entrance throat portion 29*d* providing unidirectional retaining shoulder formations at the entrance to substantially rectangular or square base socket formations 29*c* shaped and sized to receive and support portions of the shock mount arms 27,28. Outwardly projecting right angular mounting extensions 29*e* project radially outwardly from the periphery of the body portion 29 at the mounting formations 29*a*,29*b* and have slots or apertures to receive the mounting post formations 26 molded in the concave reflector portion 12 of the housing member 11 so that the mounting post formations 26 may extend through the mounting extensions 29*e* and be sonically swaged or otherwise deformed outwardly to tightly retain the U-shaped body portion 29 of the combination mounting plate and heat shield 25 rigidly supported by the reflector portion 12 of the lamp housing member 11.

Figure 5:
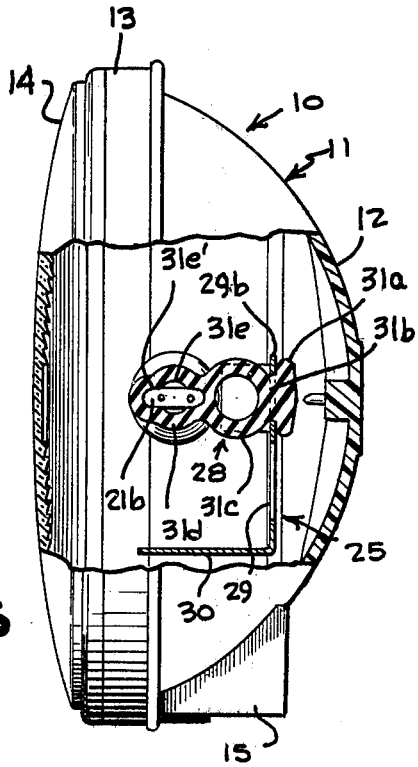
FIG. 5 is a vertical section view, taken along the line 5—5 of FIG. 3.
Figure 7:
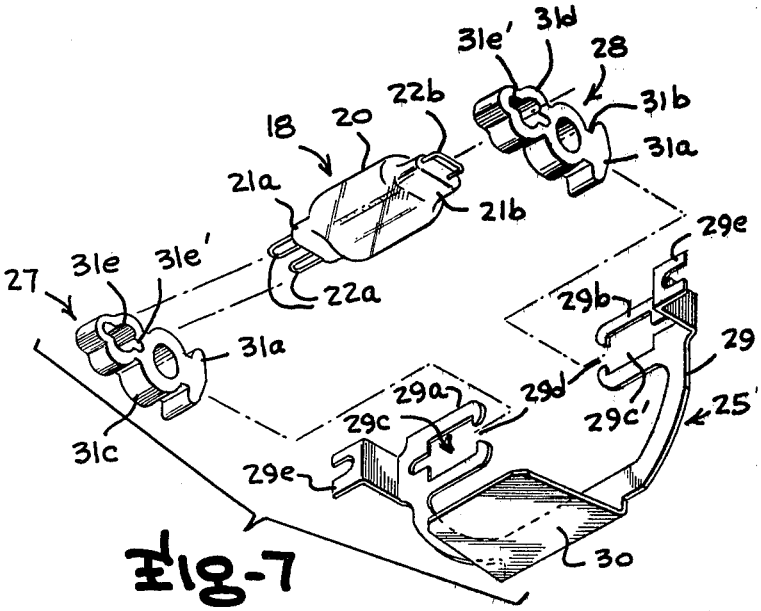
Figure 6:
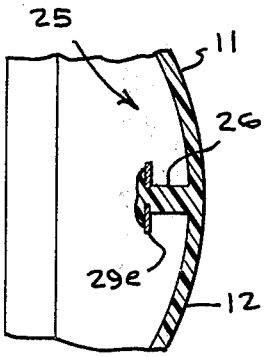
FIG. 6 is a fragmentary vertical section view, taken along the line 6—6 of FIG. 3; and, FIG. 7 is an exploded front perspective view viewed from below, of the heat shield component and the silicone rubber mounting arms and bulb.

The shock mounting arms 27,28, form forwardly projecting flexible arms parallel to each other, perpendicular to the longitudinal axis of the baseless cartridge-type bulb 18 extending rearwardly or inwardly of the housing from the bulb 18 toward the concave rear wall portion 12 of the lamp housing member 11 to the point of connection with the combination mounting plate and heat shield 25. As best illustrated in FIGS. 5 and 7, the shock mount arms 27,28 are of what may be called a distorted FIG. 8 configuration which is of rectangular form in top plan view or bottom view, and which, in side elevation, includes an enlarged mounting base formation defining oppositely projecting rounded ear portions 31*a* immediately adjacent a smaller constricted neck formation 31*b* sized to slidably and tightly interfit in the opposite slots 29*c* in the mounting formations 29*a*,29*b* so that the ears 31*a* project vertically beyond these portions of the slots 29*c* immediately rearwardly of the body portion 29. Immediately forwardly of the neck portion 31*b* is an annular circular portion 31*c* occupying most of the rear half of each mounting arm 27,28. The forwardmost half of the mounting arms 27,28 includes a generally cylindrical bulge formation 31*d* having a somewhat cross-shaped slot 31*e* extending therethrough defining a generally circular center portion and forwardly and rearwardly extending rounded end excursions 31*e*′ extending along the major axis of the slot 31*e* which occupies a horizontal plane when the mounting arms 27,28 are in the use position.

The excursions 31*e*′ collectively correspond substantially to the shape of the unbased ends 21*a*,21*b* of the glass envelope 20 of the baseless cartridge-type bulb 18 to tightly receive these unbased ends 21*a*,21*b* therein and tightly secure them in position. Thus, the slots 31*e* in the shock mount arms 27,28 form a receptacle portion of the shock mount arms and the unbased ends 21*a*,21*b* of the baseless cartridge envelope 20 are received therein and held in place by friction between the glass envelope 20 and the silicone rubber of the shock mount arms. The baseless bulb 18 is held in such a way that the filament leads 22*a*,22*b* thereof extend horizontally laterally outwardly beyond the receptacle portions of the shock mount arms 27,28 so that they may be connected electrically to appropriate contact elements by means of resistance wire.

As will be more apparent from FIG. 4, the U-shaped lead 22*a* at the unbased end 21*a* of the bulb 18, and the leads 22*b* at the opposite unbased end 21*b*, in the illustrated embodiment, are connected to lengths of resistance wire 34*a*,34*b* and 34*c*, which may be about three and a half inches long and about 0.020 inches diameter and have a resistance of about 0.719 ohms per foot, to contact elements indicated generally at 35*a*,35*b* and 35*c*, which extend into and form receptacle sockets for plug prongs in the plug housing formation 15. One of the lengths of resistance wire, for example the resistance wire 34*b*, may be a resistance wire insulated with silicone insulation, for example about 0.070 inch thick, or bare resistance wire may be jacketed with a length of Teflon tubing which is nonconductive and provides insulation for this resistance wire relative to the adjacent resistance wires.

The silicone rubber from which the shock mount arms 27,28 are formed is, in the preferred example, General Electric RTV (Room Temperature Vulcanizing) silicone rubber formed, for example, of General Electric RTV 664 RTV silicone rubber available from General Electric distributors. This is a silicone rubber molding compound which is a flowable two-component silicone rubber, which, when mixed with the appropriate commercially supplied curing agent therefor in accordance with instructions as supplied by General Electric Company, for example in the bulletin S-45 entitled The Mold Makers, and the Product Data bulletin designated RTV 664, produces a cured silicone rubber body for purposes of this application having a hardness of about 60 durometer, Shore A.

By virtue of the present construction, problems previously encountered in basket mount-type safety lamps wherein vertical shocks cause the basket to hit surfaces of the curved reflector portion of the housing and make the filament come loose through tuning fork effects are avoided, simplified assembly is achieved because of the baseless cartridge-type bulb employed, the filaments are maintained in the same plane, one in front of the other, keeping them in proper focal position with respect to the lens, and the improved performance arising from the vertical shock isolation of the bulb provided by the approximately 60 durometer silicone rubber flexible arms and the resistance to damage arising from the transversely elongated tubular configuration of the bulb and the arrangement of its filaments are all realized in this advantageous construction.

We claim:

1. A shock absorbing lamp assembly for baseless cartridge bulbs and the like for use as marker, signaling and driving lamps for on and off road motor vehicles, trailers and the like, comprising a rear backing lamp housing member serving as a reflector and lamp housing having a forwardly facing cavity bounded by a concavely-curved reflector surface defining an optical axis, a lens cover member concentric with said optical axis joined about its perimeter to the housing member to cover said cavity, an elongated baseless cartridge lamp bulb having a longitudinal bulb axis in said cavity having a glass envelope providing a generally cylindrical central bulb portion concentric with said bulb axis housing filament wire and a pair of opposite generally flattened bulb end portions of smaller vertical dimensions than the diameter of the cylindrical central portion hermetically sealing about filament support pins so that the glass envelope of the bulb rigidly supports the internal and external portions of the filament support pins in fixed spatial relationship, a baseless cartridge-type bulb mount assembly defining forwardly extending substantially parallel arms and a rearwardly spaced interconnecting base portion embracing the flattened end portions of the bulb glass envelope and extending in a U-shaped path in top plan generally rearwardly toward said reflector surface from the bulb to support the same with said bulb axis disposed horizontally and transversely intersecting said optical axis, said concavely-curved reflector surface having anchor formations and means fixing said interconnecting base portion to said anchor formations, and said arms of said bulb mount assembly being forwardly projecting vertically and laterally flexible shock absorbing arms extending parallel to each other generally perpendicular to said bulb axis from said base portion formed of rubber-like material of about 60 durometer hardness, said shock mounting arms having terminal receiving apertures formed therein for receiving said flattened end portions of the baseless bulb in frictionally constrained relation therein and having integral unitary portions projecting rearwardly into reliably supported relation with said base portion positioning said arms in parallel vertical planes substantially maintaining the filament wire of said baseless bulb horizontally disposed in proper focal position with respect to said lens cover member.

2. A shock absorbing lamp assembly as defined in claim 1, wherein said arms are of a distorted substantially FIG. 8 configuration in side elevation providing a vertically enlarging first bulge formation substantially between the longitudinal midregion thereof and said base portion lying rearwardly toward said base portion from said baseless bulb having an aperture therethrough thereby providing a vertically spaced oppositely bulging pair of curved shock absorbing legs and having a second apertured bulge portion spaced forwardly from said first bulge portion and defining the aperture for said flattened end portions of said bulb.

3. A shock absorbing lamp assembly as defined in claim 1, herein said baseless bulb is of the dual filament-type having a major filament and a minor filament extending parallel to each other and parallel to said bulb axis and lying in a common horizontal plane extending through said axis.

4. A shock absorbing lamp assembly as defined in claim 2, wherein said baseless bulb is of the dual filament-type having a major filament and a minor filament extending parallel to each other and parallel to said bulb axis and lying in a common horizontal plane extending through said axis.

5. A shock absorbing lamp assembly as defined in claim 1, wherein said base portion of said bulb mount assembly is a generally U-shaped combination mounting plate and heat shield having a generally semi-circular body portion mounted by said anchor formations in a vertical plane perpendicular and concentric to said major optical axis in the position of use of the lamp, having interfitting formations shaped relative to said anchor formations to interfit with the same for rigidly fixing the circular panel portion in said vertical position.

6. A shock absorbing lamp assembly as defined in claim 1, wherein said base portion of said bulb mount assembly is a generally U-shaped combination mounting plate and heat shield having a thin generally semi-circular body portion mounted by said anchor formations in a vertical plane transverse and perpendicular to said major optical axis in the position of use of the lamp, said body portion includes first radially outwardly projecting flange formations shaped to interfit with said anchor formations for rigidly fixing said semi-circular body portion in said vertical transverse position, and second inwardly extending flange formations, the second flange formations comprising horizontally extending radial slots opening inwardly through diametrically opposite portions of said semi-circular body portion shaped and sized to receive portions of said parallel arms in forwardly projecting relation therethrough.

7. A shock absorbing lamp assembly as defined in claim 2, wherein said base portion of said bulb mount assembly is a generally U-shaped combination mounting plate and heat shield having a generally semi-circular body portion mounted by said anchor formations in a vertical plane perpendicular and concentric to said major optical axis in the position of use of the lamp, having interfitting formations shaped relative to said anchor formations to interfit with the same for rigidly fixing the circular panel portion in said vertical position.

8. A shock absorbing lamp assembly as defined in claim 2, wherein said base portion of said bulb mount assembly is a generally U-shaped combination mounting plate and heat shield having a thin generally semi-circular body portion mounted by said anchor formations in a vertical plane transverse and perpendicular to said major optical axis in the position of use of the lamp, said body portion includes first radially outwardly projecting flange formations shaped to interfit with said anchor formations for rigidly fixing said semi-circular body portion in said vertical transverse position, and second inwardly extending flange formations, the second flange formations comprising horizontally extending radial slots opening inwardly through diametrically opposite portions of said semi-circular body portion shaped and sized to receive portions of said parallel arms immediately rearwardly of said first bulge formation to support said arms in forwardly projecting relation therethrough.

9. A shock absorbing lamp assembly as defined in claim 4, wherein said base portion of said bulb mount assembly is a generally U-shaped combination mounting plate and heat shield having a generally semi-circular body portion mounted by said anchor formations in a vertical plane perpendicular and concentric to said major optical axis in the position of use of the lamp, having interfitting formations shaped relative to said anchor formations to interfit with the same for rigidly fixing the circular panel portion in said vertical position.

10. A shock absorbing lamp assembly as defined in claim 4, wherein said base portion of said bulb mount assembly is a generally U-shaped combination mounting plate and heat shield having a thin generally semi-circular body portion mounted by said anchor formations in a vertical plane transverse and perpendicular to said major optical axis in the position of use of the lamp, said body portion includes first radially outwardly projecting flange formations shaped to interfit with said anchor formations for rigidly fixing said semi-circular body portion in said vertical transverse position, and second inwardly extending flange formations, the second flange formations comprising horizontally extending radial slots opening inwardly through diameterically opposite portions of said semi-circular body portion shaped and sized to receive portions of said parallel arms immediately rearwardly of said first bulge formation to support said arms in forwardly projecting relation therethrough.

11. A shock absorbing lamp assembly as defined in claim 6, wherein said radial slots each include a radially inner portion spaced inwardly from the perimeter of said body portion bounded by convergent shoulder formations protruding oppositely into each slot defining a constrictive entrance throat to each said slot for deforming and passing a necked portion of one of said arms through said throat and restraining the same in said inner portion of the radial slot.

12. A shock absorbing lamp assembly as defined in claim 8, wherein said radial slots each include a radially inner portion spaced inwardly from the perimeter of said body portion bounded by convergent shoulder formations protruding oppositely into each slot defining a constrictive entrance throat to each said slot for deforming and passing a necked portion of one of said arms through said throat and restraining the same in said inner portion of the radial slot.

13. A shock absorbing lamp assembly as defined in claim 1, wherein said lamp housing includes a plug housing formation having electrical contact elements fixed therein for plug connection with electrical supply and control circuits and having resistance wire connections between said contact elements and the filament support pins of said lamp bulb to reduce the voltage applied to said filament wire and thereby increase the bulb life of said lamp assembly.

14. A shock absorbing lamp assembly as defined in claim 2, wherein said lamp housing includes a plug housing formation having electrical contact elements fixed therein for plug connection with electrical supply and control circuits and having resistance wire connections between said contact elements and the filament support pins of said lamp bulb to reduce the voltage applied to said filament wire and thereby increase the bulb life of said lamp assembly.

15. A shock absorbing lamp assembly as defined in claim 3, wherein the filament wire of said baseless cartridge lamp bulb is supported in such manner with the filament support pins in said flattened bulb end portions as to provide increased resistance to heavy shock loads and severe vibration relative to base type vehicle safety lamps and wherein said lamp housing includes a plug housing formation having electrical contact elements fixed therein for plug connection with electrical supply and control circuits and having resistance wire connections between said contact elements and the filament support pins of said lamp bulb to reduce the voltage applied to said filament wire and thereby increase the bulb life of said lamp assembly, the resistance wire connecting one of said filaments of said dual filament-type bulb to said contact elements at the end of said bulb having resistance wire connection to the other filament thereof having an electrical insulating covering electrically insulating the same from the other resistance wires.

16. A shock absorbing lamp assembly as defined in claim 4, wherein the filament wire of said baseless cartridge lamp bulb is supported in such manner with the filament support pins in said flattened bulb end portions as to provide increased resistance to heavy shock loads and severe vibration relative to base type vehicle safety lamps and wherein said lamp housing includes a plug housing formation having electrical contact elements fixed therein for plug connection with electrical supply and control circuits and having resistance wire connections between said contact elements and the filament support pins of said lamp bulb to reduce the voltage applied to said filament wire and thereby increase the bulb life of said lamp assembly, the resistance wire connecting one of said filaments of said dual filament-type bulb to said contact elements at the end of said bulb having resistance wire connection to the other filament thereof having an electrical insulating covering electrically insulating the same from the other resistance wires.

17. A shock absorbing lamp assembly as defined in claim 6, wherein said lamp housing includes a plug housing formation having electrical contact elements fixed therein for plug connection with electrical supply and control circuits and having resistance wire connections between said contact elements and the filament support pins of said lamp bulb to reduce the voltage applied to said filament wire and thereby increase the bulb life of said lamp assembly.

18. A shock absorbing lamp assembly as defined in claim 8, wherein said lamp housing includes a plug housing formation having electrical contact elements fixed therein for plug connection with electrical supply and control circuits and having resistance wire connections between said contact elements and the filament support pins of said lamp bulb to reduce the voltage applied to said filament wire and thereby increase the bulb life of said lamp assembly.

19. A shock absorbing lamp assembly as defined in claim 10, wherein said lamp housing includes a plug housing formation having electrical contact elements fixed therein for plug connection with electrical supply and control circuits and having resistance wire connections between said contact elements and the filament support pins of said lamp bulb to reduce the voltage applied to said filament wire and thereby increase the bulb life of said lamp assembly, the resistance wire connecting one of said filaments of said dual filament-type bulb to said contact elements at the end of said bulb having resistance wire connection to the other filament thereof having an electrical insulating covering electrically insulating the same from the other resistance wires.

* * * * *